United States Patent [19]

Panayotou et al.

[11] Patent Number: 4,562,037

[45] Date of Patent: Dec. 31, 1985

[54] FURNACE ASSEMBLY

[75] Inventors: Nicholas F. Panayotou, Kennewick; Donald R. Green, Richland, both of Wash.; Larry S. Price, Pittsburg, Calif.

[73] Assignee: The United States of America as represented by the United States Department of Energy, Washington, D.C.

[21] Appl. No.: 469,606

[22] Filed: Feb. 24, 1983

[51] Int. Cl.[4] ..... G21C 17/00

[52] U.S. Cl. ..... 376/340; 376/245

[58] Field of Search ..... 376/245, 340, 158, 191

[56] References Cited

U.S. PATENT DOCUMENTS

| | | | |
|---|---|---|---|
| 3,860,825 | 1/1975 | Gavar et al. | 376/340 |
| 4,339,410 | 7/1982 | Satou | 376/245 |
| 4,464,330 | 8/1984 | Speir et al. | 376/340 |

FOREIGN PATENT DOCUMENTS

| | | | |
|---|---|---|---|
| 744908 | 1/1970 | Belgium | 376/340 |
| 648293 | 1/1951 | United Kingdom | 376/340 |

OTHER PUBLICATIONS

Nucl. Inst. Meth. 145 (1977), pp. 25–29, Booth et al.

"Damage Analysis and Fundamental Studies Quarterly Progress Report", (Oct.–Dec. 1980), POE/ER/0046/4, vol. 1, pp. 159–177, Doran.

*Primary Examiner*—Salvatore Cangialosi

*Attorney, Agent, or Firm*—Edward W. Nypaver; Robert Southworth, III; Judson R. Hightower

[57] ABSTRACT

A method of and apparatus for heating test specimens to desired elevated temperatures for irradiation by a high energy neutron source. A furnace assembly is provided for heating two separate groups of specimens to substantially different, elevated, isothermal temperatures in a high vacuum environment while positioning the two specimen groups symmetrically at equivalent neutron irradiating positions.

29 Claims, 8 Drawing Figures

FURNACE ASSEMBLY

BACKGROUND OF THE INVENTION

The present invention relates generally to a furnace assembly and, more particularly, to a specially constructed furnace assembly for heating test specimens exposed to a high energy neutron environnent. The United States Government has rights in this invention pursuant to Contract No. DE-AC06-76FF02170 between the U.S. Department of Energy and the Westinghouse Electric Corportion.

One of the most important considerations in the development of fusion energy is the determination of the effect of high energy neutrons on candidate fusion materials. Near term fusion reactors will subject structural metals to a high energy neutron environment while operating at temperatures ranging from 50° C. to 300° C. Since the extrapolation of fission reactor data to cover the effects of high energy neutrons on the mechanical properties of structural metals is not reliable, elevated temperature, high energy neutron irradiation experiments must be conducted in support of the fusion materials development program.

However, problems are encountered in conducting such high energy neutron irradiation experiemnts because high energy neutron sources are characterized by a relatively low peak neutron flux and by large neutron flux gradients with increasing distances away from the source. For example, the Rotating Target Neutron Source (RTNS)-II facility, deemed the world's most intense high energy neutron source, located at the Lawrence Livermore National Laboratory offers experimenters a primary irradiation volume having a peak neutron flux of $2\times10^{12}$ n/cm$^2$.s at an energy level of 14 MeV. This source produces a primary irradiation volume, which is that volume of the neutron field available to experimenters for irradiating test specimens, of only about 0.2 cc and is located within about 2.5 mm of the rotating target assembly. For room temperature experiments, specimens could be placed within substantially all of the primary irradiation volume if they were covered with a thin enough membrane. However, attempts to conduct experiments on specimens that must be heated to elevated temperatures poses problems in accessing any part of this primary irradiation volume because of the space requirements necessitated by the specimen supporting and heating apparatus as well as the deteriorating effect of radiative heat transfer from such excessively heated apparatus onto the target reactant material.

SUMMARY OF THE INVENTION

Accordingly, it is a primary object of the present invention to provide a new and useful apparatus for and method of heating test specimens to desired elevated temperatures while positioning the same within a significant portion of the available neutron field for optimum irradiation testing.

It is another object of this invention to provide a new and useful furnace assembly having two independent, isothermal temperature zones for maintaining two distinct groups of specimens at substantially different termperatures while being irradiated simultaneously at equivalent flux positions.

It is still another object of the present invention to provide an arrangement for efficiently insulating the two temperature zones from each other and from the associated housing to minimize heat losses and maintain isothermal conditions.

It is a further object of this invention to provide in the foregoing furnace assembly a support arrangement for maintaining the position of the specimens fixed relative to the neutron source regardless of temperature variations.

It is still a further object of the present invention to provide a furnace assembly operative for conducting irradiation experiments on heated specimens while minimizing the residual radioactivity induced therein.

These and other objects, advantages, and characterizing features of the present invention will become clearly apparent from the ensuing detailed description of an illustrative embodiment thereof, taken together with the accompanying drawings, wherein like reference numerals denote like parts throughout the various views.

The invention comprises a method of and apparatus for heating test specimens to desired elevated temperatures for irradiation by a high energy neutron source including generating a high energy neutron source having a primary irradiation volume, positioning two groups of specimens axially within at least a portion of said primary irradiation volume, symmetrically locating said two specimen groups in a slightly radially spaced apart relation on opposite sides of the axis of said volume but within the radial extent of said volume, and heating said two groups of specimens at different elevated temperatures, respectively, if desired, while simultaneously irradiating said specimens.

DESCRIPTION OF THE PREFERRED EMBODIMENT

Figure 1:
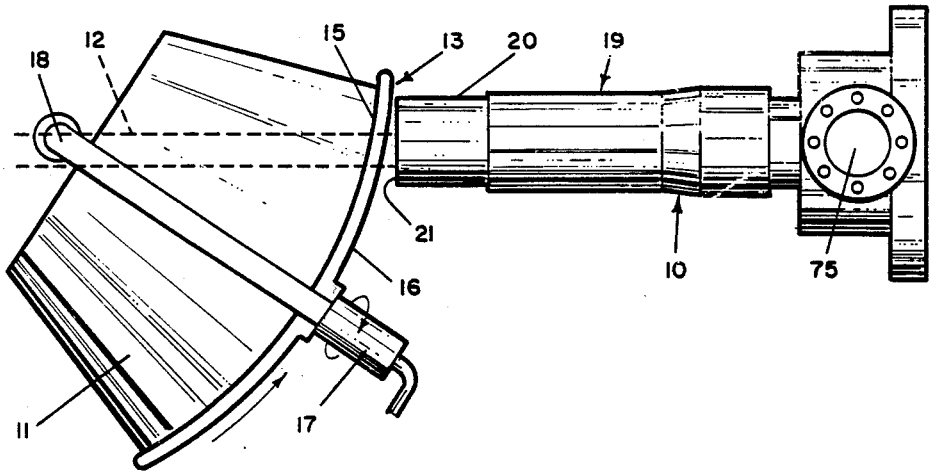
FIG. 1 is a schematic side elevational view of the furnace assembly of this invention shown in an operative position in association with a rotating target neutron source generator.

Referring now in detail to the illustrative embodiment depicted in the accompanying drawings, there is shown in FIG. 1 a furnace assembly, comprehensively designated 10, embodying the novel features of this invention and shown in an operative position adjacent to and aligned with a neutron generator 11 of the type known as a Rotating Target Neutron Source (RTNS)-II generator operative to produce a high energy neutron source. While the furnace of this invention is conveniently described in connection with a Rotating Target Neutron Source generator, it should be understood that the subject furnace is not restricted thereto, but has utility with any other generator capable of producing a radiation source.

Basically, the neutron generator 11 is an accelerator-based neutron source which employs a 400 KeV deuteron beam, identified at 12 in FIG. 1, directed onto a water-cooled copper alloy target 13 of generally dish-shaped configuration having curved inner and outer surfaces 15 and 16. The inner surface 15 is loaded with a layer of a tritium-containing compound to produce neutrons by a T(d,n) type reaction. The deuteron beam 12 is incident on a relatively small zone or area (approximately 1 cm in diamater for example) of the target 13, producing a radiating neutron source at an energy level of approximately 14 MeV. In order to limit the peak temperature to which the tritium-containing layer is driven and thereby avoid undesirable tritium disassociation and loss, the target 13 is continuously rotated about its axis 17 at about 5,000 rpm to present to the deuteron beam different areas of the target 13 within a circular band. The fixed beam 12 remains on this circular band area until the yield, as measured by a suitable proton-recoil counter (not shown) used in conjunction with the generator 11, has dropped to a predetermined percentage amount of the initial value. The target 13 is then shifted about a horizontally extending pivot axis 18 to a fresh circular band area to the beam 12. This procedure is repeated to utilize all the tritium on the entire inner surface 15 of the target 13. Thus, the target 13 is rotated and pivoted bodily during operation while the position of the deutreron beam 12 and the furnace 10 remain fixed.

The generator 11 is typical of all high energy sources in that it is characterized by a relatively low peak neutron flux and large gradients in the neutron flux with increasing distance from the source. The furnace assembly 10 can be safely positioned as close as 0.5 mm from the outer surface 16 of the rotating target 13 without otherwise interfering with the movement of the rotating target and without excessively heating the tritium disposed thereon. This distance, coupled with the distance for accommodating the thickness and geometry of target 13, results in a combined distance from the source in which none of the neutron flux is available for the irradiation of test specimens. The neutron flux immediately contiguous and axially outwardly of this unavailable portion is referred to as the "primary irradiation volume". It is this volume that experimenters hope to access for the optimum irradiation testing of structural metal specimens.

Figure 2:
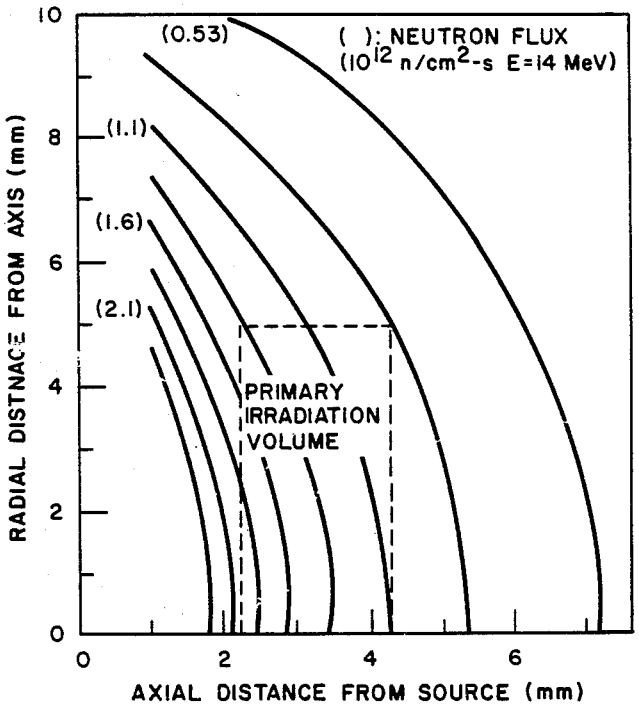
FIG. 2 is a graph showing the primary irradiation volume developed by a rotary target neutron generator as compared with the isoflux contours of a symmetrical neutron field generated thereby.

Specifically, the primary irradiation volume developed by the above described rotating target neutron generator 11 is located about 2.3 mm from the neutron source. Its volume is only about 0.2 cc and is defined as a cylindrical volume of about 1O mm in diameter and 2 mm in axial length. The diameter of the primary irradiation volume is approximately the diameter of the target area onto which the deuteron beam is directed. The axial length of the primary irradiation volume is determined by the distance measured from the point of maximum neutron flux to a point where the maximum neutron flux is halved. This distance measures 2 mm in the instant case. The graph of FIG. 2 illustrates the primary irradiation volume (only ½ shown) as compared with the isoflux contours of the symmetrical neutron field produced by generator 11.

This primary irradiation volume is centered on an axis coincident with the beam axis and extends 2 mm axially away from the hereinbefore mentioned 2.3 mm axial position. Over this volume, the neutron flux ranges from a maximum of $2.0\times10^{12}$ n/cm$^2$.s at the 2.3 mm axial position to a minimum value of $7.9\times1O^{11}$ n/cm$^2$.s at the 4.3 mm axial position. Thus, the optimum positioning of a specimen for experimental purposes in order to obtain the maximum dosage available in the primary irradiation volume would be along the beam axis 2.3 mm away from the neutron source. In actual practice, however, where a specimen must be heated to and desirably maintained at predetermined elevated temperatures under controlled conditions, ideal specimen positioning is impossible to achieve. Attempts to access even a portion of this primary irradiation volume have not been very successful due to the problems encountered in controlling the specimen environment and specimen thermal gradients.

The furnace 10 constructed in accordance with this invention addresses these problems and provides a solution therefor by permitting the placement of test specimens within at least 50% of the primary irradiation volume under highly controlled temperature and thermal gradient conditions. Moreover, in an effort to efficiently employ the neutron facility generator time and to fully utilize the primary irradiation volume, the furnace 10 permits two distinct groups of specimens to be irradiated simultaneously in equivalent flux positions within such primary irradiation volume but at two distinct and independent temperatures.

Figure 3:
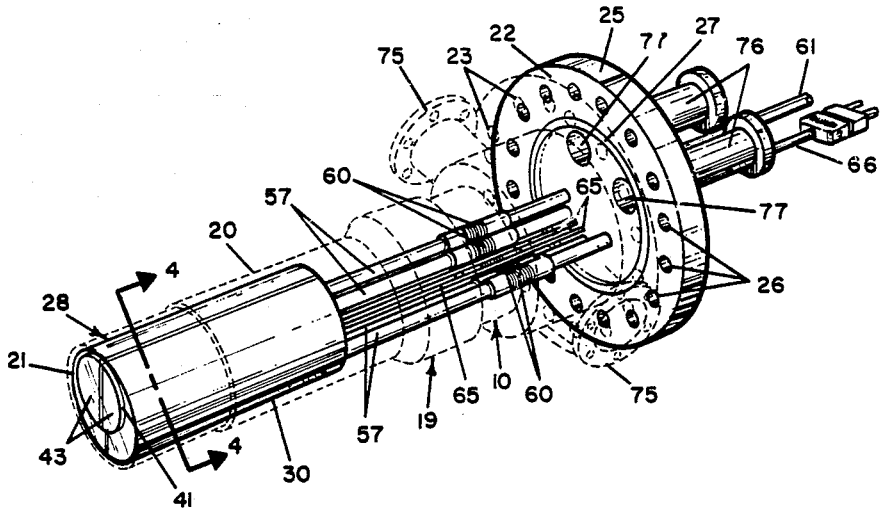
FIG. 3 is a perspective view, with the housing shown in dashed outline for ease of description, of the furnace assembly constructed in accordance with this invention.

To this end, and as best shown in FIG. 3, wherein the furnace is oriented 180° from its normal operative position to better illustrate the internal structure thereof, the furnace 10 comprises a housing 19 including an elongated casing or enclosure 20 having a leading or forward end provided with a flexible end cover 21 sometimes referred to as a "neutron window" suitably brazed onto the forward end portion of enclosure 20. The enclosure 20 and end cover 21 preferably are formed of an aluminum alloy to minimize residual induced radioactivity of the furnace system. Indeed, it has been found that after a typical facility cooldown period of two days, the residual induced radioactivity of this system is about 1,000 times less than prior known all stainless steel furnace systems.

The other or rear end of the enclosure 20 is welded to an annular closure plate or flange 22 formed of stainless steel with a plurality of circumferentially spaced tapped openings 23 therein. Plate 22 is detachably mounted to a complementary stainless steel base plate or flange 25 also formed with openings 26 for receiving suitable bolts (not shown) therethrough for threaded securement into the tapped openings 23. The plates 22 and 25 are sealed in a fluid tight relation by means of a copper seal 27 adapted to be deformed on its opposite sides by annular V-shaped ridges formed on the inner mating surfaces of both plates 22 and 25. Thus, the elongated enclosure 20, front end cover 21, and the composite closure plate assembly comprised of plates 22 and 25 form an air-tight housing completely encapsulating the furnace components hereinafter described.

A furnace core assembly, generally designated 28, is suitably mounted within the housing 19 and comprises a pair of solid, semi-cylindrical core elements or specimen enclosures 30 of identical construction and which are disposed in a slightly spaced apart relation within the housing 19. Since the two core elements 30 are identical in structure and mirror images of each other as arranged in their assembled relation, any reference in the description to one will suffice for both, the same reference characters being applied to similar parts. Each solid core element 30 is formed of a high thermal conductivity metal, preferably oxygen-free copper, having a flat, planar base portion 31 and an arcuate surface 32 defining a semi-circle.

Each core element 30 is formed with a plurality of elongated bores extending lengthwise completely through the core element to accomodate specimen holders as will be hereinafter described. The first of these bores is identified by reference numeral 33 and is located off center of the core element 30 in close proximity to the base 31, being separated from the exterior of the core element by only a thin wall membrane. The bore 33 is of a rectangular cross sectional configuration (FIG. 4) adapted to receive a complementary shaped specimen cartridge or holder 35. The outside dimensions of the specimen cartridge 35 are slightly smaller than the cross sectional dimensions of bore 33 to allow some clearance therebetween for ease of insertion and removal of the cartridge 35 into and out of bore 33.

Figure 6:
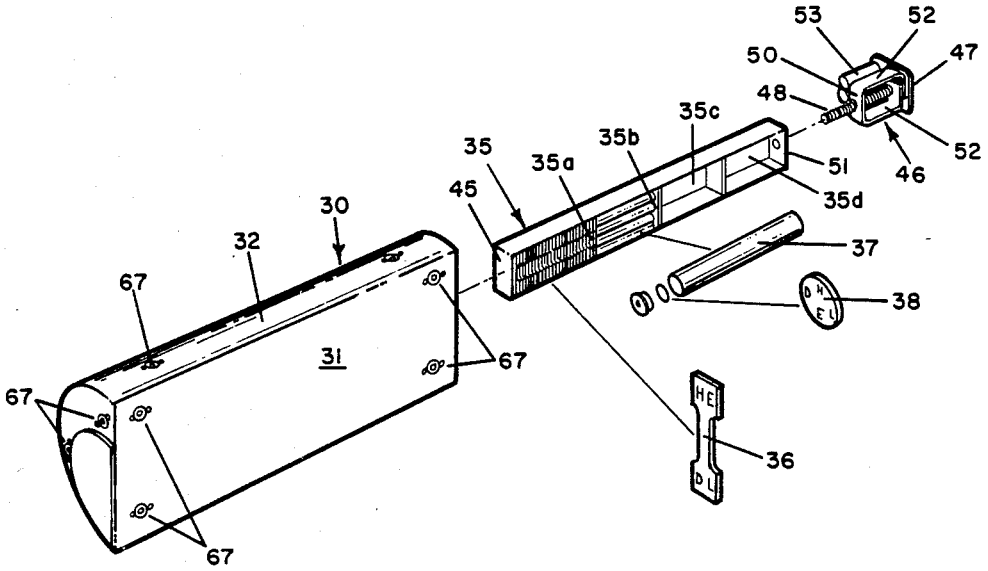
FIG. 6 is an exploded view of the various specimens and specimen cartridge adapted to be contained within a core element.

As best shown in FIG. 6, the specimen cartridge 35 is of a rectangular box-like construction partitioned into four separate compartments 35*a*–35*d* for containing a plurality of miniature test specimens. For example, a plurality of miniature tensile specimens 36 can be stacked longitudinally in three lateral rows in compartment 35*a* while a number of cylindrical packets 37 disposed in a vertically stacked relation can be inserted in compartment 35*b*. Each of the packets 37, in turn, contain a plurality of miniature circular disk specimens 38, such as transmission electron microscopy (TEM) disks. Preferably test specimens are utilized to minimize the flux gradient within a single specimen.

Figure 4:
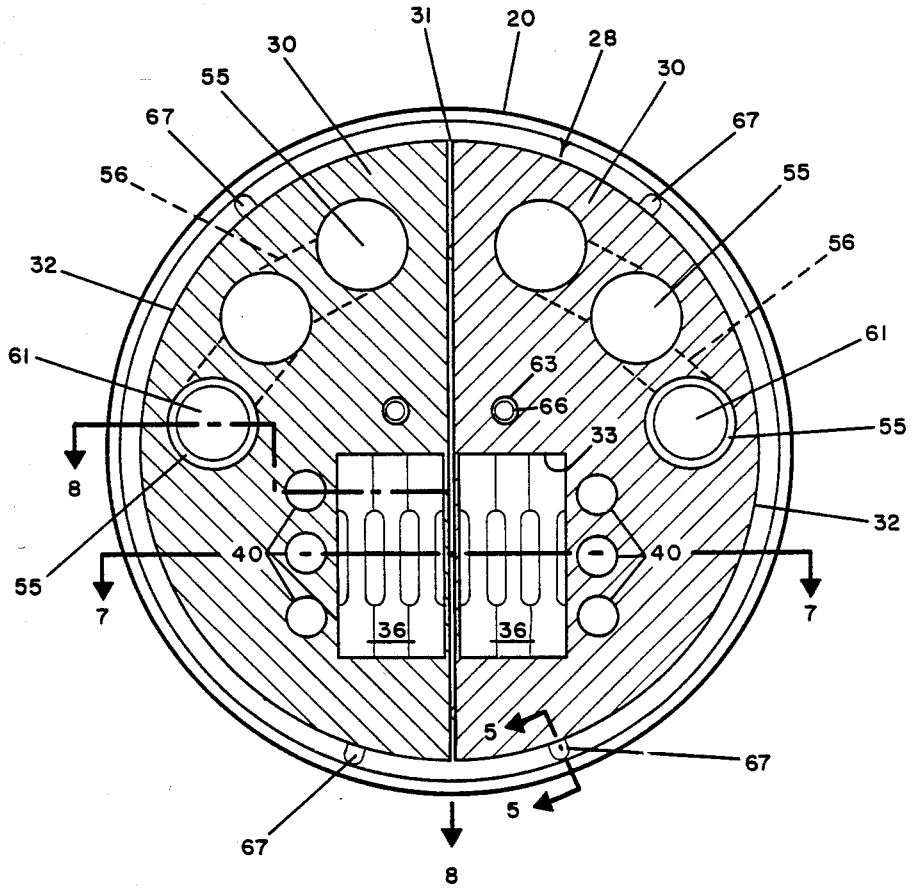
FIG. 4 is a cross sectional view, on an enlarged scale, taken along the line 4—4 of FIG. 3.

As shown in FIG. 4, three vertically spaced bores 40 of circular cross section are formed in each core element 30 adjacent the bore 33 and also extend lengthwise through the element 30. These bores 40 are adapted to accommodate the complementary shaped cylindrical packets 37, if desired, in addition to, or in lieu of, carrying them in specimen cartridge 35.

Figure 7:
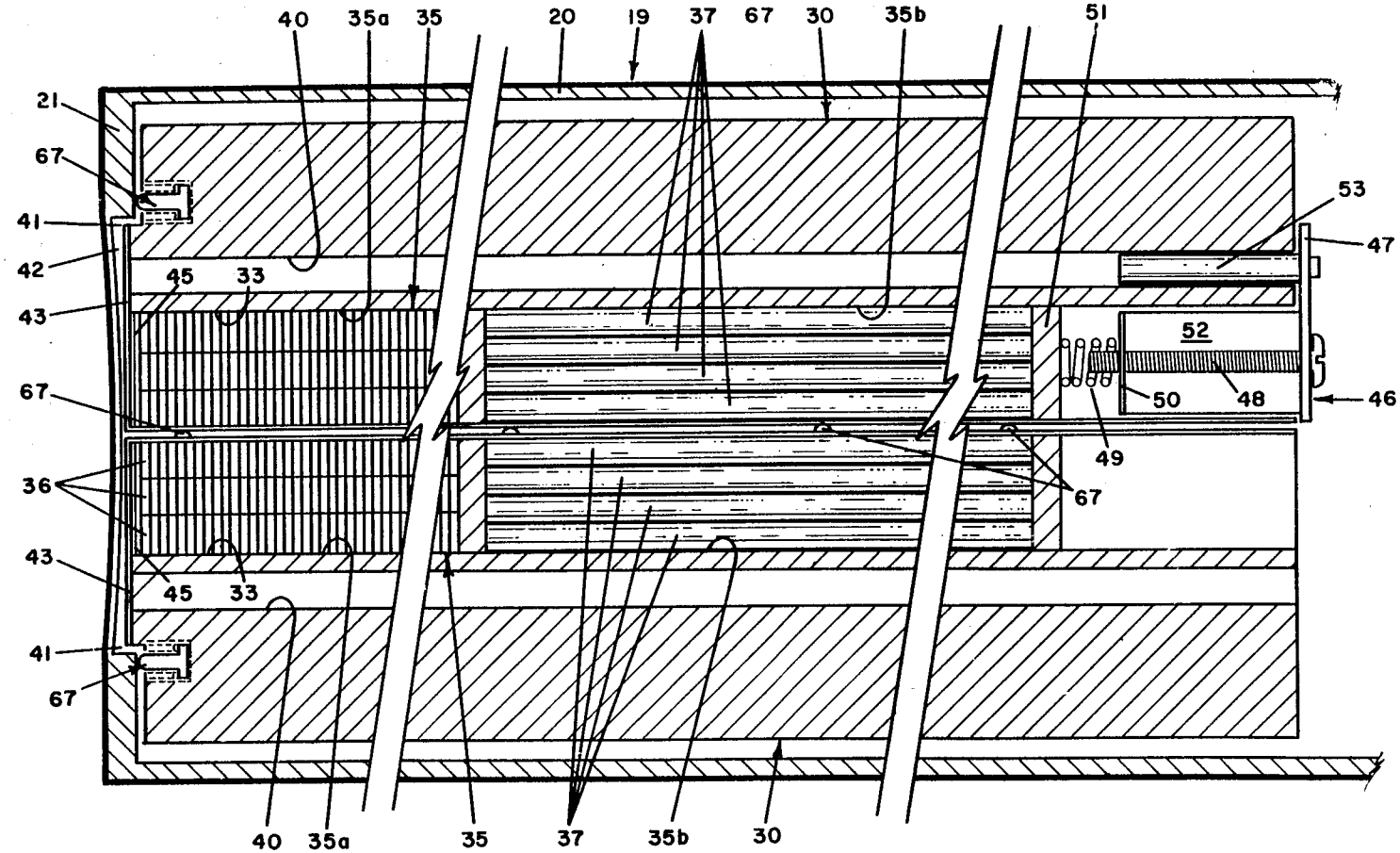
FIG. 7 is a longitudinal sectional view, on an enlarged scale, taken along line 7—7 of FIG. 4.
Figure 8:
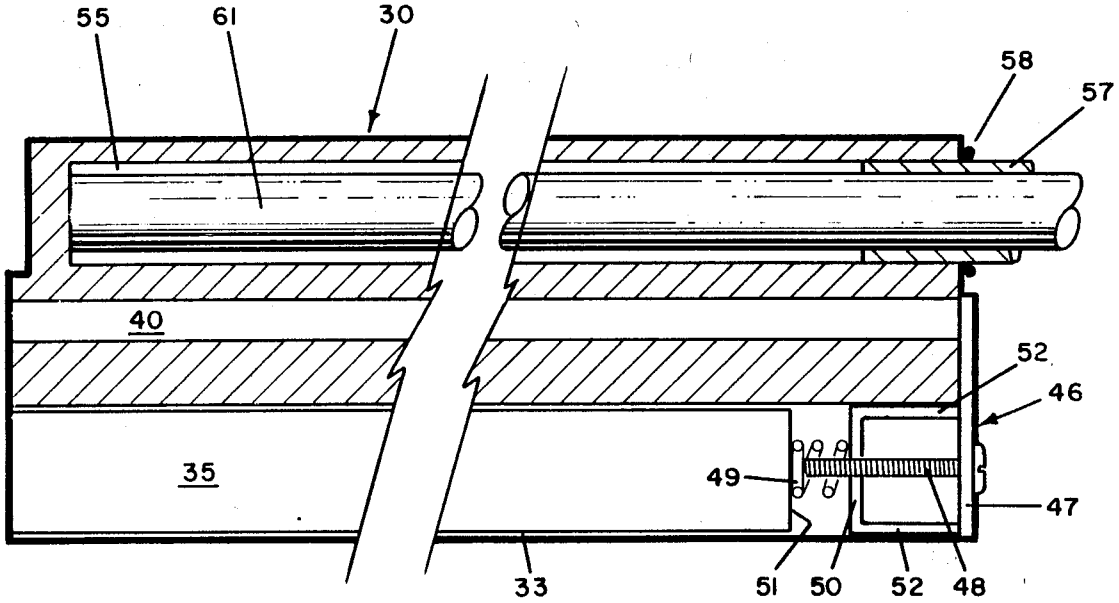
FIG. 8 is a longitudinal sectional view, on an enlarged scale, taken along line 8—8 of FIG. 4.

Referring to FIGS. 3 and 7, a portion of each core element 30 protrudes axially forwardly of the remainder of the core element to form an axial land 41 of semi-cylindrical configuration encompassing the forward ends of bores 33 and 40. The housing end cover 21 is formed with a complementary shaped depression or cavity 42 to accommodate both lands 41 formed on the end faces of core elements 30. A thin sheet or foil 43 (FIG. 7) of copper is suitably brazed onto the end face of each land 41 in order to completely seal off the front ends of bores 33 and 40. The foil 43 is purposely made thin, having a thickness on the order of 0.13 mm for example, in order to permit the positioning of the specimen cartridge 35 as near as possible to the neutron source. Likewise, the front wall of cartridge 35 is formed of an extremely thin steel foil 45 having a thickness of approximately 0.02 mm in order to allow placement of the leading specimen as close as possible to the neutron source. These thin foils, along with the forward disposition of core lands 41 as accommodated by the cavity 42 in cover 21 all facilitate greater axial access of the test specimens to the primary irradiation volume.

The rear end of the bore 33 is closed by a specially designed removable plug assembly 46 which is inserted behind the cartridge holder 35 and maintains the same in place. The plug 46 also serves as a thermal radiation shield by making good thermal contact with the wall surface defining bore 33 of core element 30 and completing the enclosure around the specimen positions to assist in maintaining an isothermal condition surrounding the specimens.

The plug assembly 46 comprises a closure member or thermal radiation shield 47 formed of copper and having a screw 48 extending therethrough and through the web of a generally U-shaped expandable plug member 50. A helical spring 49 is disposed about the inner end of screw 48 between plug 50 and the rear wall 51 of cartridge 35 to bias the same inwardly and maintain it in the desired axial position. The outer or head end of screw 48 is formed with an enlarged, slotted formation for receiving an appropriate tool. The plug assembly 46 is placed in the rear end of bore 33 with the spaced apart legs 52 of the plug 50 disposed in their normal parallel relation. Threading of the screw 48 in the appropriate direction effects radial spreading of the legs 52 in a diverging relation into pressure engagement against the walls defining the bore 33 to tightly secure the plug assembly 46 in place. The plug assembly 46 also is provided with three cylindrical studs 53 affixed to the inner surface of sheild 47 and insertable into the rear end of the three circular bores 40. This plug assembly 46 serves to complete the enclosure about the specimens and contributes significantly to the formation of an isothermal temperature zone. For example, measurements made under prototypic conditions without the plugs in place revealed specimen temperature differences approaching 40° C. over the rear half of the furnace core assembly as compared to ±1° C. over the entire core assembly with the plug assemblies 46 in place.

In addition to bores 33 and 40, three longitudinally extending passages 55 of larger circular cross sectional areas than bores 40 also are formed in core element 30 in a circumferencially spaced array radially outwardly of the specimen positions. These passages 55 extend axially from the rear end face of core element 30 and terminate inwardly from the inner end face thereof. As best shown in FIG. 4, cross passages 56 interconnect the three passages 55 for a purpose that will hereinafter be described. The rear portions of passages 55 receive the inner forward ends of tubes 57 which are brazed, as at 58, about their peripheries to the wall surfaces defining the passages 55 adjacent the rear end of each core element 30. The tubes 57 extend outwardly from the core element 30 and are welded at their respective rear ends to the inner face of closure plate 22. Suitable aligned openings formed in plates 22 and 25 are coaxially aligned with the tubes 57 to provide access into the passages 55 from the outer side of base plate 25. The tubes 57 are provided with expansible bellows 60 to accommodate any axial thermal expansion of the core elements 30 and consequent undesirable shifting of the specimens away from their desired positions.

One of the passages 55 receives a cartridge heater 61 easily insertable and removable through the access opening provided in the closure plate assembly and attached tube 57. The heater 61 preferably is an electrial resistance wire type heater connected at its outer end to a suitable electrical power source (not shown). The annular gap between the heater 61 and the wall defining passage 55 is made as small as practicable in order to minimize the termperature drop thereacross. Thus, the electrical heat produced by the heater 61 is substantially totally transferred to the specimen enclosure defined by the core element 30 surrounding heater 61. The two core elements or specimen enclosures 30, which define separate temperature zones, can be heated to different temperatures up to 400° C. and can differ by as much as 320° C. Of course, these temperature zones can be heated to the same temperature, if desired.

An overtemperature thermocouple (not shown) similarly is removably disposed in another of the passages 55 and is connected at its outer end to suitable monitoring and control equipment (also not shown). In the event of inadvertent or accidental temperature excesses or heater malfunction as sensed by this thermocouple, the monitoring equipment becomes operative to deenergize the heating cartridge 61 for removal and/or replacement.

The third passage 55 provides a conduit for introducing a cooling gas, such as nitrogen for example, adapted to be circulated through the several passages 55 via cross passages 56 for quenching purposes and for controlling the temperature of the cooler core element 30, as will further be described in connection with the operation of the furnace 10.

Still another passage 63 of relatively small circular cross sectional area is formed in each core element 30 and is spaced vertically from the specimen bore 33. The passage 63 extends from the rear face of core element 30 and terminates inwardly from the inner or front end face thereof. A tube 65 is welded into the rear portion of passage 63 and projects through aligned openings formed in plates 22 and 25 to provide access for the insertion and removal of a control thermocouple 66 positioned in the passage 63. The tube 65 is provided with a bellows (not shown) exteriorly of the housing on the outer side of base plate 25 for accommodating axial thermal expansion of the core elements 30. This thermocouple 66 provides both a control and termperature indicating function.

As earlier noted, the peak dose of the primary irradiation volume is obtained along the neutron beam axis at a distance of 2.3 mm from the neutron source. However, since the deuteron beam has a diameter of about 10 mm, locating the specimens a small distance radially away from the beam axis as compared to the source size will have only a negligible affect on the flux or peak dose received by the specimens. By symmetrically positioning the opposed specimen zones of the two core elements 30 on opposite sides of the beam axis in close proximity thereto, say within about 10% of the neutron source diameter, the several specimens in both zones can be simultaneously irradiated at two different temperatures.

The means for spacing core elements 30 away from each other the desired distance, such as 0.2 mm for example, and from the enclosure 20 includes a plurality of ceramic standoffs or spacers 67. Four such spacers 67 are provided about the peripheral arcuate surface 32 of each core element 30 for engagement with the inner wall surface of enclosure 20 and four identical spacers 67 are provided on the planar surface of the base 31 of one of the elements 30 for engagement with the base 31 of the opposed core element 30. Also, two spacers 67 are positioned on the front end face of each element 30 radially outwardly from the land 41 formed thereon. These last mentioned spacers 67 serve as a stop engaging the thicker portion of end cover 21 under the vacuum conditions hereinafter described. The several ceramic spacers 67 prevent displacement of the core elements as a result of thermal expansion and assist in maintaining the specimens in their desired optimum positions relative to the neutron source.

Figure 5:
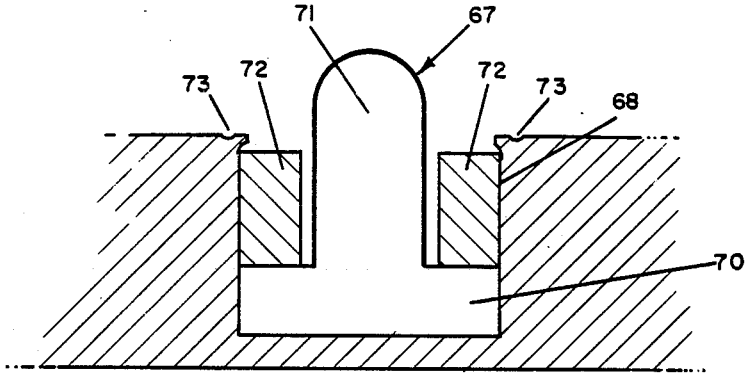
FIG. 5 is a fragmentary, sectional view, on an enlarged scale, taken along line 5—5 of FIG. 4.

In order to minimize, if not eliminate, heat losses through the spacers 67, they are seated in recesses 68 formed in their respective core elements 30. Referring to FIG. 5, each spacer 67 is of an inverted T-shaped configuration having a base portion 70 seated in recess 68 and an upright stud 71 extending therefrom. A steel retaining ring 72 is positioned in the recess 68 on top of base 70 and is radially spaced from the stud 71 to preclude thermal conduction therebetween. The ring 72, and thereby spacer 67, is held in place by swaging or upsetting the copper metal, as shown at 73, at diametrically opposite sides of ring 72. Thus, the specially configurated spacers 67 provide an effective length substantially greater than the distance between the core elements 30 and between the latter and enclosure 20 with a consequent increase in their thermal conductive path lengths to further minimize heat losses through such spacers.

A significant feature of the present invention resides in maintaining the specimen enclosures defined by core elements 30 at isothermal conditions during the irradiation experiments in order to the eliminate the problem of heat radiation losses from the specimens themselves, which typically have variable specimen-to-specimen and specimen-to-heat source contact conductance. By the provision of an isothermal enclosure surrounding all of the test specimens, the only effect of this variable contact conductance is to change the time it takes for all specimens to arrive at the desired equilibrium or uniform temperature.

One of the factors contributing to the attainment of an isothermal condition is in forming the core elements 30 of a high conductivity metal, preferably copper for example. Also, positioning the heaters 61 and thermocouples 66 in gas filled passages within the specimen enclosure provides much better thermal coupling thereto than if the heaters otherwise were contained in the housing 19 exteriorly of the core elements 30. Moreover, the heat generated by heaters 61 is substantially totally transfered to the specimen enclosures by designing the annular gaps between the heaters and the walls of their respective passages as small as practicable to minimize temperature drops thereacross.

To further ensure isothermal conditions, heat losses from the core elements 30 constituting the specimen enclosures must be minimized. To this end, a vaccuum environment is provided within the housing 19 to thermally isolate the temperature zones from each other and from the housing 19. This is deemed the most efficient technique for isolating the temperature zones at temperatures of 400° C. and below, which is the desired temperature parameter for the furnace assembly of this invention.

The high vacuum condition within housing 19 is maintained by an ion pump (not shown) located exteriorly of the housing 19 and connected thereto by suitable vacuum ports 75. The advantage of an ion pump is that it possesses no movable parts and is not as vulnerable to mechanical failure as other known mechanical vacuum pumps. Typical operating vacuum levels at the vacuum ports 75 are $2\times10^{-8}$ torr and at the specimen positions approximately $2\times10^{-6}$ torr. In addition to this high vacuum environment surrounding the core elements 30, heat losses are kept to a minimum by the use of the specially configurated spacers 67 hereinbefore described, and by carefully preparing all core element radiating surfaces to reduce their emissivity. The above features all contribute in maintaining isothermal conditions within the specimen enclosures wherein the temperature in either zone is maintained uniform within ±1° C.

In completing the structure of furnace assembly 10, it should be noted that a pair of access tubes 76 are welded to the outer face of the closure plate 25 in registry with coaxially aligned openings 77 formed therein. This arrangement permits the insertion of calibration equipment and thermocouples into the furnace for checking thermal gradients during the bench checking thereof for example, and are not utilized during normal operation of the furnace.

In preparing the furnace assembly 10 for operation, the composite core assembly 28 which, along with the tubes 57, 65 and closure base plate 25, constitute a unit which is removable axially from within the housing enclosure 20 in order to insert the specimens. The specimen cartridge 35 is loaded with the upright sheet-type tensile specimens in a stacked relation in three lateral rows in the first compartment 35*a*, for example, against the thin front wall 45 while one or more of the other compartments can accommodate a stack of the packets 37 which contain the TEM disks. The specimens can be formed of various metallic alloys adapted to be irradiated to determine the effect of high energy neutrons on such candidate fusion alloys.

When loaded, each specimen cartridge 35 is inserted into the rear end of bore 33 and pressed gently against the closure formed by copper foil 43. If desired, separate disk packets 37 also can be inserted into the cylindrical specimen bores 40. Once positioned, the rear plug assembly 46 is inserted in place and the screw 48 tightened to expand the legs 52 of the plug into engagement with the walls of bore 33 to secure the assembly in place. It shoud be noted that a small clearance is provided between shield 47 and the rear end face of core element 30 to permit vaccuum pumping within the bore 33. The entire core assembly 28 is then oriented properly and carefully inserted into the housing enclosure 20. The closure plates 22 and 25 are then sealably secured together by tightening the circumferentially spaced bolts. The cartridge heater 61, overtemperature thermocouple and control thermocouple 66 are inserted into their respective passages. The vacuum pump is then energized to establish a vacuum within housing 19 and the furnace assembly 10 is ready for positioning in front of the rotating target 13 of neutron generator 11.

The forward end of the furnace assembly 10, i.e. the outer face of end cover 21, is positioned at the closest distance possible from the neutron source, specifically the 2.3 mm distance hereinbefore referred to and with the off center axis of the composite lands coincident with the neutron beam axis. The primary irradiation volume, however, can not be fully utilized because of the space occupied by the furnace components forwardly of the foremost specimens. Also, allowance must be made for the inward deflection of end cover 21 and the vacuum gap between such deflected cover and the core element lands 41. For example, the specimens nearest to the neutron source are restrained by the cartridge forward wall 45 formed of a 0.02 mm thick stainless steel foil. The copper cover foil 43 brazed onto the front face of the core element 30 and the thickness of the end cover 21 adds another 0.13 mm and 0.5 mm, respectively. Additionally, a clearance of 0.35 mm must be provided between the end cover 21 and foil 43 to accommodate a 0.25 mm cover deflection under vacuum (FIG. 7) with the remaining space allotted for the insulation vacuum gap therebetween. Subtracting this total 1.0 mm from the available 2.0 mm primary irradiation volume leaves an effective 1.0 mm or 50% access of the specimens to the primary irradiation volume. The specific dimensions reiterated above are illustrative only of the particular embodiment disclosed and should not be taken as limiting the scope of the present invention.

During actual operation, it takes approximately 20 minutes for the temperature of the core elements 30 to reach and then stabilize at the desired test temperatures, namely 288° C. and 80° C., respectively. Temperature control is provided by proportional controllers. Nitrogen gas is circulated through the gas cooling passages 55 in the cooler furnace core element 30 during normal operation. This is necessary since otherwise the few watts of heat radiated from a 288° C. core element would result in a temperature in excess of 80° C. in the other opposed core element 30. Accordingly, the furnace is operated so that the temperature of the cooler core element 30 is conveniently regulated at 80° C. using electrical heating in opposition to a low flow of cooling gas.

Nitrogen gas is circulated through both core elements 30 and at a higher flow rate when it is desired to quench the specimens. Quenching to temperatures significantly below the test temperatures is required in order to limit annealing of radiation induced damage during interruptions in the neutron availability. Quenching from 288° C. and 80° C. requires about 30 minutes. Therefore, the furnace assembly 10 of this invention can be taken from a cold start to the required test temperatures and quenched in 50 minutes. The ability to cycle a furnace system this rapidly is a significant capability at an accelerator based neutron generator like the RTNS-II facility since it does not operate continuously and is subject to unscheduled interruptions of the neutron flux.

From the foregoing, it is apparent that the objects of the invention have been fully accomplished. A new and useful furnace assembly is provided for heating two groups of test speciemns at two distinct, independent temperatures, if desired, while positioning the same in equivalent flux positions within the primary irradiation volume for optimum irradiation. The specimen groups are located within two isothermal temperature zones maintained at the desired elevated but different temperatures within ±1° C. A high vacuum environment is provided for efficiently insulating the temperature zones from each other and from their common housing. Moreover, the radiating surfaces of the core elements defining the specimen enclosures or temperature zones are specially treated to reduce thermal emissivity. Furthermore, the provision of ceramic spacers mounted in surface recesses of the core elements to provide increased effective lengths and resultant increased thermal paths also serve to minimize heat losses otherwise caused by thermal conduction between the core elements and between the latter and the housing. These several features all contribute in maintaining the temperature zones at the desired isothermal temperatures and, together with the positioning of specimens within at least 50% of the primary irradiation volume of the neutron field, provides an optimum environment for the irradiation testing of structural metals.

In addition, specimens can be heated and cooled rapidly in order to make the system compatible with the operation of an accelerator based neutron source. Not only is this furnace assembly reliable and easily serviced, providing easy access to the heating elements and thermocouples for quick removal and replacement, but also minimizes post irradiation handling problems.

It is to be understood that the form of the invention herewith shown and described is to be taken as an illustrative embodiment only of the same, and that various changes in the shape, size and arrangement of parts, as well as various procedural changes, may be resorted without departing from the spirit of the invention.

We claim:

1. A method for heating test specimens to desired elevated temperatures for irradiation by a high energy neutron source comprising: generating a high energy neutron source having a primary irradiation volume, completely encapsulating two groups of specimens within an enclosure, positioning said two groups of encapsulated specimens axially within at least a portion of said primary irradiation volume, symmetrically locating said two specimen groups in a slightly radially spaced apart relation within said enclosure on opposite sides of the axis of said volume, heating said two groups of specimens to selected elevated temperatures, respectively, while simultaneously irradiating said specimens, and maintaining isothermal temperatures for said two groups of specimens within said enclosure at said selected temperatures.

2. A method for heating test specimens according to claim 1, wherein said isothermal temperatures for said two groups of specimens, respectively, are maintained within 1° C.

3. A method for heating test specimens according to claim 1, wherein said selected temperatures are substantially different for the two groups of specimens, respectively.

4. A method for heating test specimens according to claim 2, wherein said selected temperatures differ by approximately 300° C.

5. A method for heating test specimens according to claim 1, including thermally insulating said two groups of specimens from each other while disposed in equivalent flux irradiating positions to assist in maintaining said groups at said different isothermal temperatures.

6. A method for heating test specimens according to claim 1, including establishing a vacuum level within said enclosure of approximately $2\times10^{-8}$ torr.

7. A furnace assembly for heating test specimens adapted to be irradiated by a high energy neutron source having a primary irradiation volume comprising: a housing having a forward end positioned within the primary irradiation volume of said neutron source, a core assembly mounted in said housing in annular spaced relation thereto, said core assembly comprising a pair of coextensive thermal conducting core elements in a slightly radially spaced apart relation, said core elements having bores extending lengthwise thereof in close radial proximity to the axis of said primary irradiation volume, said bores of said core elements defining separate temperature zones for receiving two groups of specimens, respectively, positioned within at least a portion of said primary irradiation volume, means for completely encapsulating said two groups of specimens within said core elements, respectively, means in said core elements for heating said specimens in said temperature zones to selected elevated temperatures, respectively, while being simultaneously irradiated, and means for maintaining isothermal temperatures for said two groups of specimens at said selected temperatures.

8. A furnace assembly according to claim 7, wherein said selected temperatures differ substantially from each other.

9. A furnace assembly according to claim 7, wherein said specimens are positioned within about 50% of said primary irradiation volume at equivalent positions relative to the neutron source.

10. A furnace assembly according to calim 7, wherein said housing comprises an elongated casing having a flexible cover rigidly secured to the forward end thereof and a closure plate assembly affixed to the other end thereof.

11. A furnace assembly according to claim 10, wherein said casing and cover are formed of an aluminum alloy minimizing residual radioactivity induced in said furnace assembly.

12. A furnace assembly according to claim 7, wherein said core elements are semi-cylindrical in shape.

13. A furnace assembly according to claim 1, wherein said core elements are formed of oxygen-free copper.

14. A furnace assembly according to claim 7, wherein said core elements are provided at their forward ends with land formations having end faces projecting axially forwardly of the remainder of the core elements and through which said bores extend, said land formations forming a composite configuration coaxially aligned with said primary irradiation volume.

15. A furnace assembly according to claim 14, including a thin foil rigidly secured to each of said end faces of said land formations for closing the forward end of the associated bore.

16. A furnace assembly according to claim 15, including a flexible cover rigidly secured to the forward end of said housing and having a cavity formed therein complementary to the composite configuration of said land formations on said core elements.

17. A furnace assembly according to claim 7, including a cartridge for containing a plurality of test specimens, said cartridge being removably insertable into each of said bores against a cover foil affixed to the forward end of said associated core element.

18. A furnace assembly according to claim 17, wherein said cartridge is formed with a thin front wall and divided into separate compartments for receiving different test specimens.

19. A furnace assembly according to claim 18, including a plurality of additional bores formed in each of said core elements in close proximity to said first mentioned bore and coextensive therewith for receiving additional test specimens.

20. A furnace assembly according to claim 7, including a plurality of elongated passages in each of said core elements and means in said housing for accessing said passages from the exterior of said housing.

21. A furnace assembly according to claim 20, wherein said heating means comprises a heating element positioned in one of said passages for easy removal and replacement through said access means.

22. A furnace assembly according to claim 20, including a thermocouple positioned in another one of said passages for easy removal and replacement through said access means.

23. A furnace assembly according to claim 20, including further passage means interconnecting said passages for circulating a cooling gas through the several passages.

24. A furnace assembly according to claim 7, including means for thermally insulating said core elements from each other and from said housing to maintain said zones at said selected isothermal temperatures.

25. A furnace assembly according to claim 24, wherein said insulating means comprises a vacuum environment of approximately $2\times10^{-8}$ torr established within said housing.

26. A furnace assembly according to claim 24, wherein said insulating means includes a plurality of spacers formed of a ceramic material and separating said core elements from each other and from said housing.

27. A furnace assembly according to claim 26, wherein said spacers are elongated studs releasably mounted in recesses formed in the outer surfaces of said core elements to increase the effective thermal path lengths thereof.

28. A furnace assembly according to claim 7, wherein said core elements having highly polished radiating surfaces yielding low emissivity characteristics.

29. A furnace assembly according to claim 19, including a removable plug assembly for closing the rearward ends of said additional bores.

* * * * *